US011732438B2

(12) United States Patent
Uemura et al.

(10) Patent No.: US 11,732,438 B2
(45) Date of Patent: Aug. 22, 2023

(54) SYSTEM AND METHOD FOR CONTROLLING BULLDOZER

(71) Applicant: KOMATSU LTD., Tokyo (JP)

(72) Inventors: Takuya Uemura, Tokyo (JP); Yusuke Yamazaki, Tokyo (JP); Kei Nakano, Tokyo (JP); Masahiro Ikeda, Tokyo (JP)

(73) Assignee: KOMATSU LTD., Tokyo (JP)

( * ) Notice: Subject to any disclaimer, the term of this patent is extended or adjusted under 35 U.S.C. 154(b) by 584 days.

(21) Appl. No.: 16/891,939

(22) Filed: Jun. 3, 2020

(65) Prior Publication Data

US 2021/0025127 A1 Jan. 28, 2021

(30) Foreign Application Priority Data

Jul. 22, 2019 (JP) ..... 2019-134678

(51) Int. Cl.
*E02F 3/84* (2006.01)
*E02F 3/76* (2006.01)
*E02F 9/20* (2006.01)

(52) U.S. Cl.
CPC ..... *E02F 3/844* (2013.01); *E02F 3/7613* (2013.01); *E02F 3/7618* (2013.01); *E02F 9/2004* (2013.01)

(58) Field of Classification Search
CPC ..... E02F 3/844; E02F 3/7613; E02F 3/7618; E02F 9/2004
See application file for complete search history.

(56) References Cited

U.S. PATENT DOCUMENTS 5,862,868 A 1/1999 Yamamoto et al.
8,437,926 B2 * 5/2013 Shintani ..... E02F 9/2228 701/50
8,473,166 B2 6/2013 Zhdanov et al.
2006/0070746 A1 4/2006 Lumpkins et al.
(Continued)

FOREIGN PATENT DOCUMENTS

JP 6-212660 A 8/1994
JP 8-199620 A 8/1996
(Continued)

OTHER PUBLICATIONS

Examination report No. 1 for the corresponding Australian application No. 2020203633, dated Feb. 16, 2021.
(Continued)

*Primary Examiner* — Peter D Nolan
*Assistant Examiner* — Demetra R Smith-Stewart
(74) *Attorney, Agent, or Firm* — Global IP Counselors, LLP

(57) ABSTRACT

A controller determines that a signal from an operating device represents either a normal operation to manually control a blade or a trigger operation to automatically control the blade. The controller moves the blade so that the angle of the blade is changed in accordance with the operation of the operating device when the signal from the operating device is determined as representing a normal operation. The controller moves the blade until the angle of the blade reaches a predetermined target angle when the signal from the operating device is determined as representing the trigger operation while the bulldozer is traveling.

14 Claims, 10 Drawing Sheets

(56) References Cited

U.S. PATENT DOCUMENTS

| | | | | |
|---|---|---|---|---|
| 2013/0000930 | A1* | 1/2013 | Shintani | E02F 9/2228 701/50 |
| 2013/0204499 | A1 | 8/2013 | Buckmier et al. | |
| 2014/0343800 | A1* | 11/2014 | Nelson | E02F 3/845 701/49 |
| 2019/0382984 | A1 | 12/2019 | Hagiwara et al. | |
| 2020/0263389 | A1* | 8/2020 | Harada | E02F 3/847 |

FOREIGN PATENT DOCUMENTS

| | | | | |
|---|---|---|---|---|
| JP | 4140940 | B2 * | 8/2008 | E02F 3/432 |
| JP | 5143975 | B2 | 2/2013 | |
| JP | 2015-8678 | A | 1/2015 | |
| JP | 2018-145651 | A | 9/2018 | |

OTHER PUBLICATIONS

The Office Action for the corresponding Japanese application No. 2019-134678, dated Dec. 20, 2022.

* cited by examiner

SYSTEM AND METHOD FOR CONTROLLING BULLDOZER

CROSS-REFERENCE TO RELATED APPLICATIONS

This application claims priority to Japanese Patent Application No. 2019-134678 filed on Jul. 22, 2019, the disclosure of which is hereby incorporated herein by reference in its entirety.

BACKGROUND

Field of the Invention

The present invention relates to a system and a method for controlling a bulldozer.

Background Information

Conventionally, a bulldozer includes an operating member for automatically adjusting the angle of a blade. For example, the bulldozer in Japanese Patent No. 5143975 includes a blade operating lever and an auto-pitch button. The operator is able to manually adjust the angle of the blade by operating the blade operating lever. In addition, when the operator presses the auto-pitch button, the angle of the blade is automatically adjusted to become a predetermined target angle.

SUMMARY

In the abovementioned bulldozer, the operator needs to operate different operating members when manually adjusting the angle of the blade and automatically adjusting the angle of the blade. As a result, the operations for adjusting the angle of the blade are complicated.

An object of the present disclosure is to improve operability for adjusting the angle of the blade in a bulldozer.

A system according to a first aspect is a system for controlling a bulldozer including a blade. The system includes an operating device and a controller. The operating device outputs a signal corresponding to an operation by an operator. The controller receives the signal from the operating device. The controller determines that the signal from the operating device represents either a normal operation for manually controlling the blade or a trigger operation for automatically controlling the blade. The controller moves the blade so that the angle of the blade is changed in accordance with the operation of the operating device when the signal from the operating device is determined as representing the normal operation. The controller moves the blade until the angle of the blade reaches a predetermined target angle when the signal from the operating device is determined as representing the trigger operation during the travel of the bulldozer.

A system according to a second aspect is a method for controlling a bulldozer including a blade. The method includes the following processes. A first process involves receiving a signal in accordance with an operation of an operating device by an operator. The second process involves determining that the signal represents either a normal operation for manually controlling the blade or a trigger operation for automatically controlling the blade. The third process involves moving the blade so that the angle of the blade is changed in accordance with the operation of the operating device when the signal is determined as representing a normal operation. The fourth process involves moving the blade until the angle of the blade reaches a predetermined target angle when the signal is determined as representing the trigger operation while the bulldozer is traveling.

DETAILED DESCRIPTION OF EMBODIMENT(S)

Figure 1:
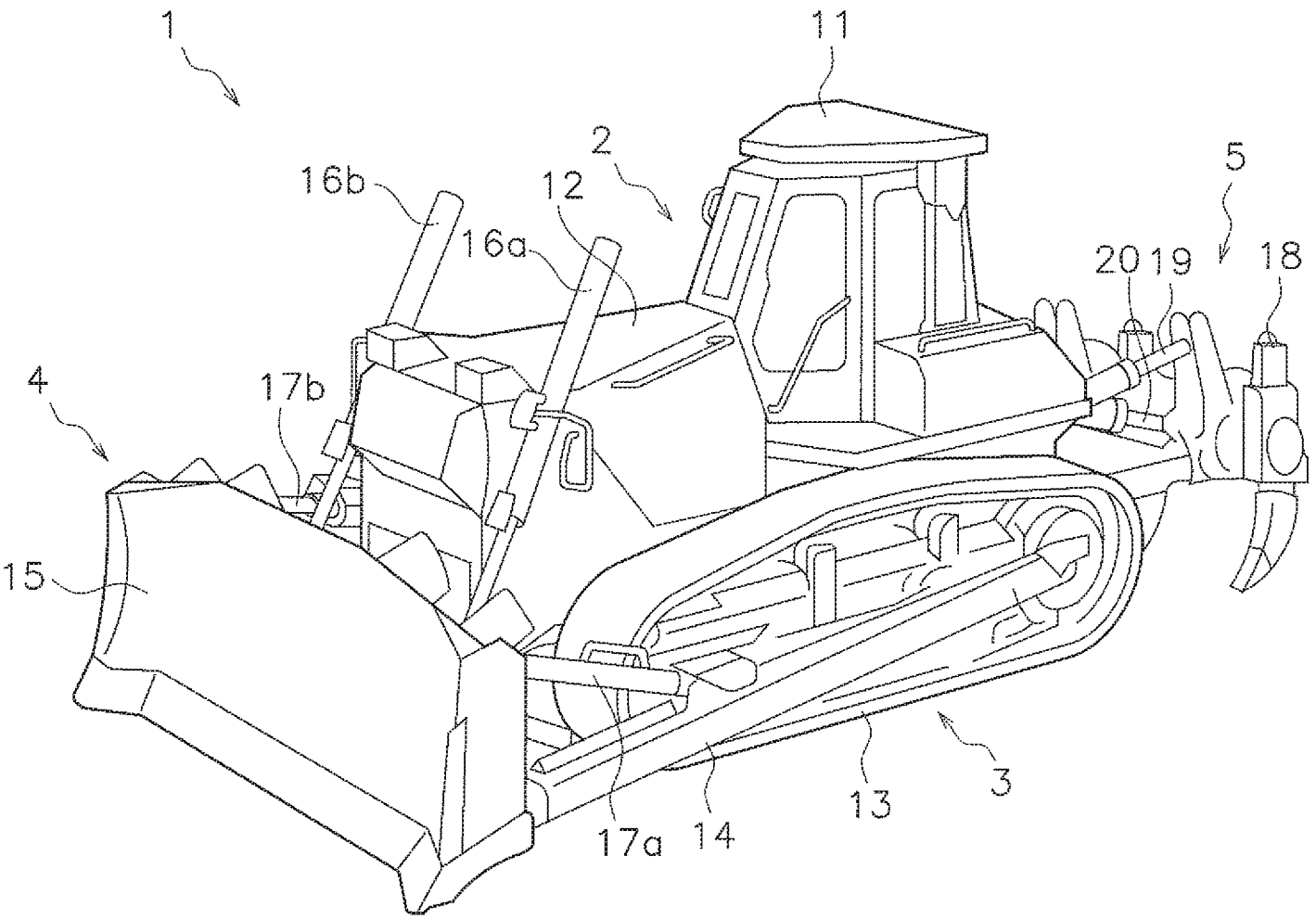
FIG. 1 is a perspective view of a work machine according to an embodiment.

Hereinbelow, embodiments of the present invention will be described with reference to the drawings. FIG. 1 is a perspective view of a bulldozer 1 according to an embodiment. The bulldozer 1 includes a vehicle body 2, a travel device 3, a first work implement 4, and a second work implement 5.

The vehicle body 2 has an operating cabin 11 and an engine compartment 12. The engine compartment 12 is disposed in front of the operating cabin 11. The travel device 3 is attached to the vehicle body 2. The travel device 3 includes left and right crawler belts 13. Only the crawler belt 13 on the left side is illustrated in FIG. 1. The bulldozer 1 travels due to the rotation of the crawler belts 13.

Figure 2:
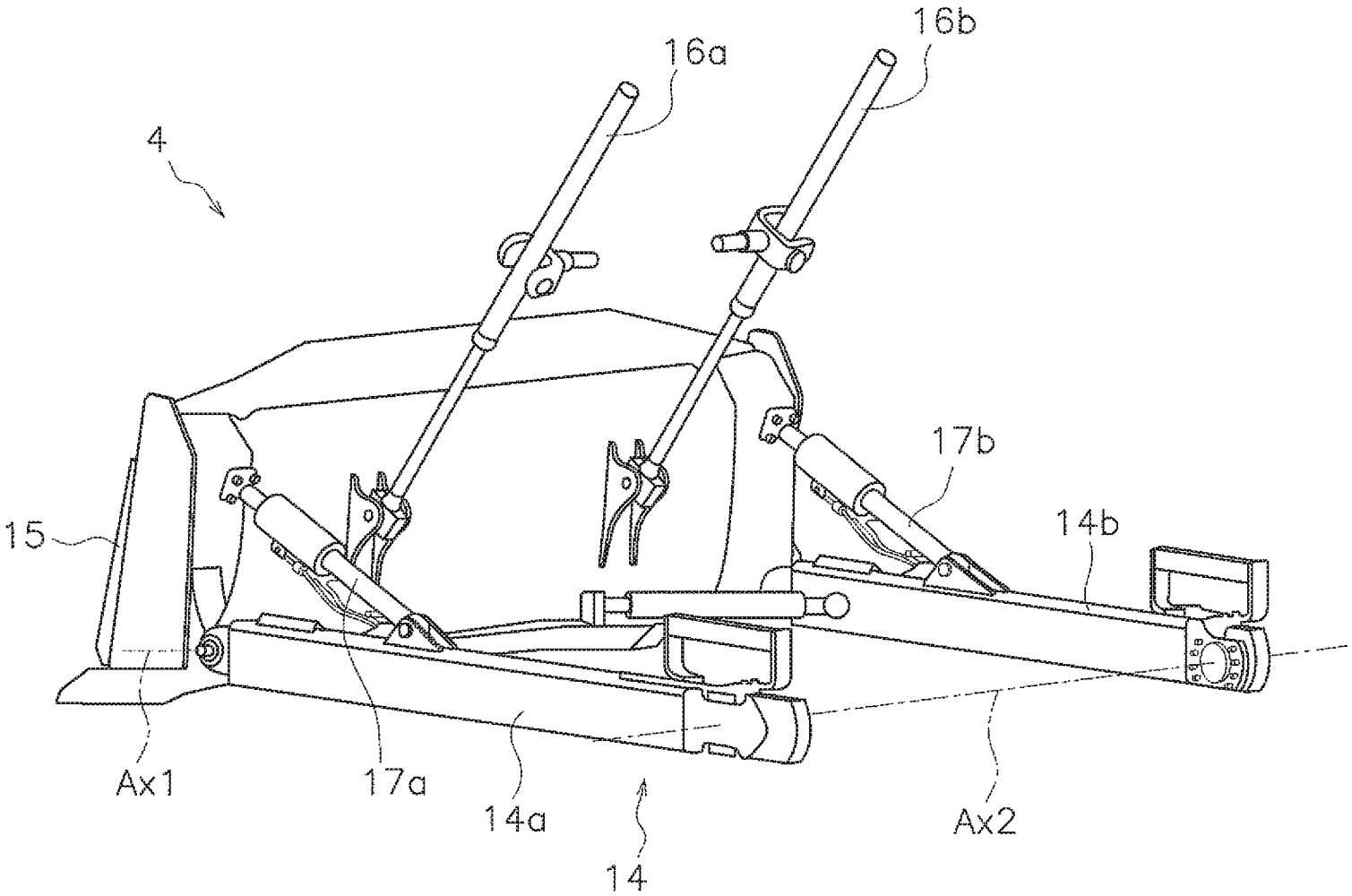
FIG. 2 is a perspective view of a first work implement.

The first work implement 4 is attached to the vehicle body 2. FIG. 2 is a perspective view of the first work implement 4. As illustrated in FIG. 2, the first work implement 4 includes a lift frame 14, a blade 15, lift cylinders 16*a* and 16*b*, and tilt cylinders 17*a* and 17*b*.

The lift frame 14 supports the blade 15. The blade 15 is disposed in front of the vehicle body 2. The blade 15 is attached to the lift frame 14 in a manner that allows movement around a first rotating axis Ax1. The first rotating axis Ax1 extends in the vehicle width direction.

The lift frame 14 is attached to the travel device 3 in a manner that allows movement around a second rotating axis Ax2. The second rotating axis As extends in the vehicle width direction. The lift frame 14 may be attached to the vehicle body 2. The lift frame 14 includes a left frame 14*a* and a right frame 14*b*. The blade 15 moves up and down accompanying the up and down movements of the lift frame 14.

The lift cylinders 16*a* and 16*b* are connected to the blade 15 and the vehicle body 2. The lift cylinders 16*a* and 16*b* include a left lift cylinder 16*a* and a right lift cylinder 16*b*. Due to the extension and contraction of the lift cylinders 16*a* and 16*b*, the lift frame 14 moves around the second rotating axis Ax1. Consequently, the blade 15 moves up and down.

The tilt cylinders 17*a* and 17*b* are connected to the lift frame 14 and the blade 15. The tilt cylinders 17*a* and 17*b* include a left tilt cylinder 17*a* and a right tilt cylinder 17*b*. The left tilt cylinder 17*a* is connected to the left lift frame 14*a* and the blade 15. The right tilt cylinder 17*b* is connected to the right frame 14*b* and the blade 15.

The left tilt cylinder 17*a* and the right tilt cylinder 17*b* both extend and contract whereby the blade 15 moves around the first rotating axis Ax1. Consequently, the blade 15 is tilted in the front-back direction. The tilting movement of the blade 15 in the front-back direction is called a pitch movement. Specifically, the left tilt cylinder 17*a* and the right tilt cylinder 17*b* both extend whereby the blade 15 tilts forward. The left tilt cylinder 17*a* and the right tilt cylinder 17*b* both contract whereby the blade 15 tilts rearward.

By stopping one of the left tilt cylinder 17*a* and the right tilt cylinder 17*b* and extending the other thereof, the blade 15 tilts in the left-right direction. The tilting movement of the blade 15 in the left-right direction is called a tilting movement. Specifically, by extending the left tilt cylinder 17*a* and stopping the right tilt cylinder 17*b*, the left side of the blade 15 moves upward (hereinbelow, this movement is called left tilt). By extending the right tilt cylinder 17*b* and stopping the left tilt cylinder 17*a*, the right side of the blade 15 moves upward (hereinbelow, this movement is called right tilt).

As illustrated in FIG. 1, the second work implement 5 is attached to the vehicle body 2. The second work implement 5 includes a ripper 18 and ripper cylinders 19 and 20. The ripper 18 is disposed behind the vehicle body 2. The ripper cylinders 19 and 20 move the ripper 18.

Figure 3:
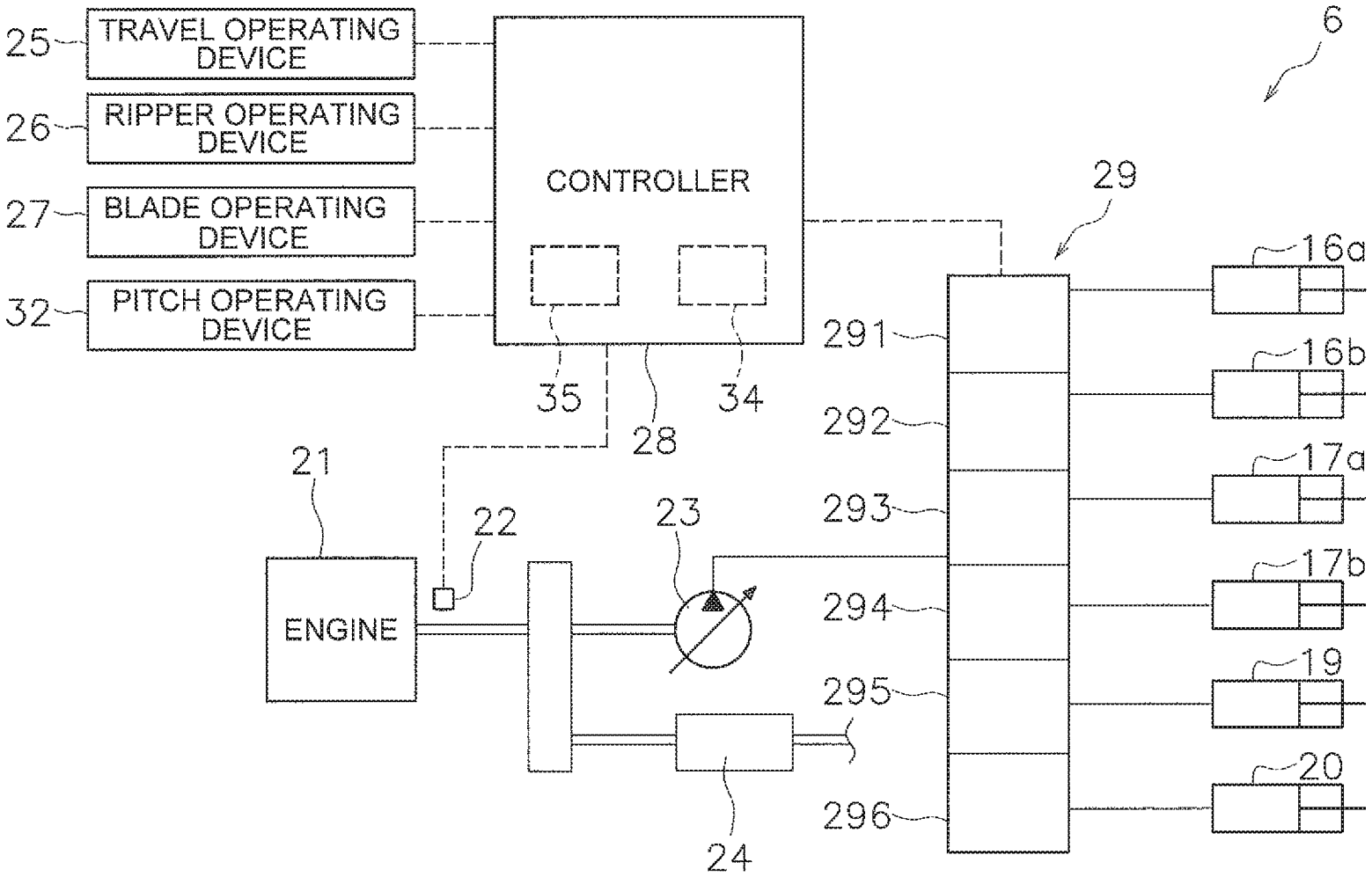
FIG. 3 is a block diagram of a configuration of a control system of the work machine.

FIG. 3 is a block diagram illustrating a configuration of a control system 6 of the bulldozer 1. In the present embodiment, the control system 6 is mounted on the bulldozer 1. As illustrated in FIG. 3, the bulldozer 1 includes an engine 21, an engine sensor 22, a hydraulic pump 23, and a power transmission device 24. The engine sensor 22 detects the engine rotation speed. The hydraulic pump 23 is driven by the engine 21 to discharge hydraulic fluid. The hydraulic fluid discharged from the hydraulic pump 23 is supplied to the lift cylinders 16*a* and 16*b*, the tilt cylinders 17*a* and 17*b*, and the ripper cylinders 19 and 20. While only one hydraulic pump 23 is illustrated in FIG. 3, a plurality of hydraulic pumps may be provided.

The power transmission device 24 transmits driving power of the engine 21 to the travel device 3. The power transmission device 24 may be a hydrostatic transmission (HST), for example. Alternatively, the power transmission device 24, for example, may be a transmission having a torque converter or a plurality of speed change gears.

Figure 4:
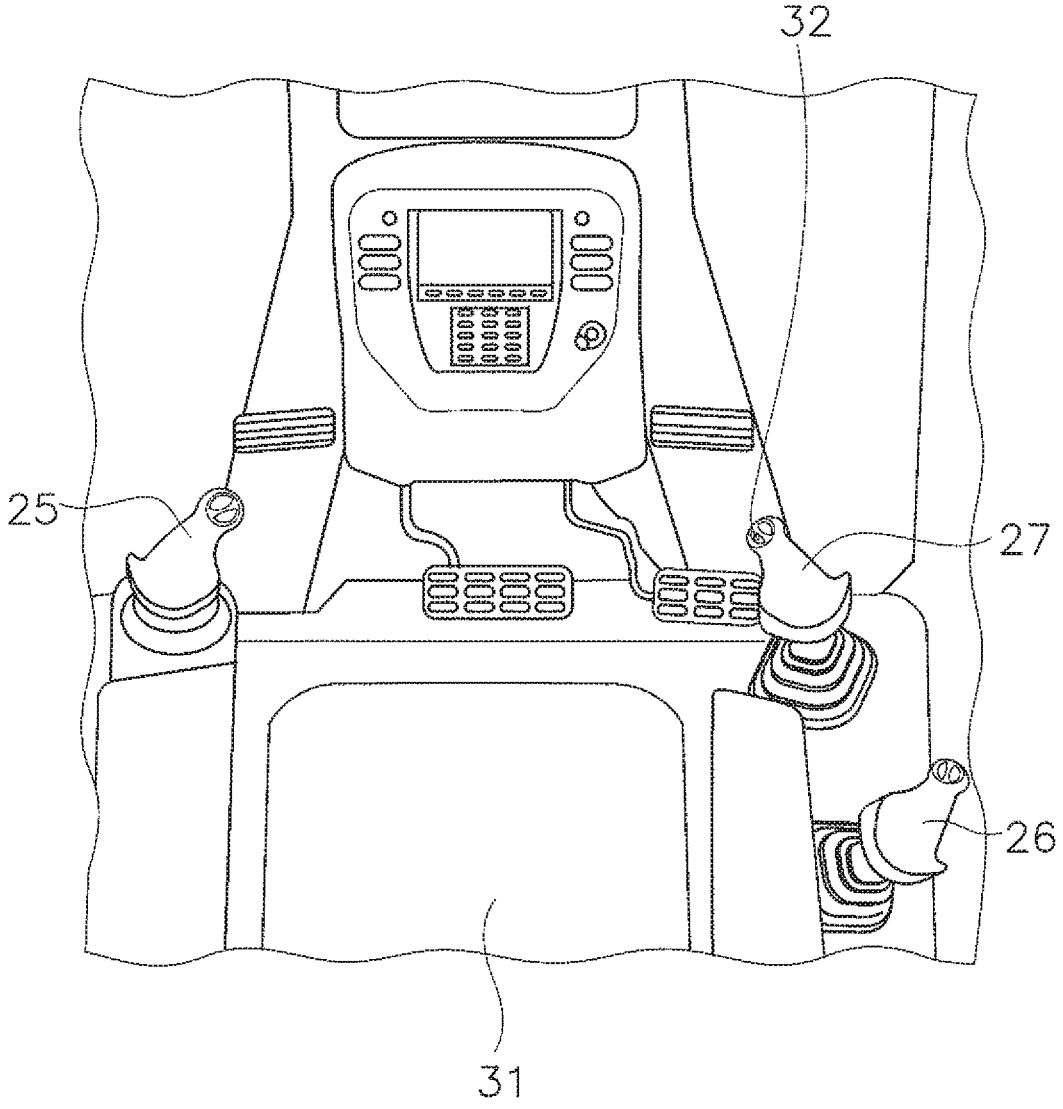
FIG. 4 illustrates an operating cabin interior.

The control system 6 includes a travel operating device 25, a ripper operating device 26, a blade operating device 27, a pitch operating device 32, a controller 28, and a control valve 29. The travel operating device 25, the ripper operating device 26, the blade operating device 27, and the pitch operating device 32 are disposed in the operating cabin 11. FIG. 4 illustrates the inside of the operating cabin 11. As illustrated in FIG. 4, a seat 31 is disposed inside the operating cabin 11. The travel operating device 25, the ripper operating device 26, the blade operating device 27, and the pitch operating device 32 are operable by the operator. The travel operating device 25, the ripper operating device 26, the blade operating device 27, and the pitch operating device 32 are disposed at the left and right sides of the seat 31.

In the present embodiment, the travel operating device 25 is a lever. The travel of the bulldozer 1 is controlled in accordance with the operation of the travel operating device 25. The travel operating device 25 are operable forward and backward and left and right. The travel operating device 25 outputs an operation signal in accordance with the operating direction of the travel operating device 25. The travel operating device 25 receives the operation by the operator and outputs the operation signal to the controller 28.

In the present embodiment, the ripper operating device 26 is a lever. The movement of the ripper 18 is controlled in accordance with the operation of the ripper operating device 26. The ripper operating device 26 is operable forward and backward or left and right. The ripper operating device 26 outputs an operation signal in accordance with the operating direction of the ripper operating device 26. The ripper operating device 26 receives the operation by the operator and outputs the operation signal to the controller 28.

In the present embodiment, the blade operating device 27 is a lever. The movement of the blade 15 is controlled in accordance with the operation of the blade operating device 27. The blade operating device 27 is operable forward and backward and left and right. The upward, downward, left tilt and right tilt movements of the blade 15 are controlled in accordance with the operation of the blade operating device 27. The blade operating device 27 outputs an operation signal in accordance with the operating direction of the blade operating device 27. The blade operating device 27 receives the operation by the operator and outputs the operation signal to the controller 28.

The travel operating device 25, the ripper operating device 26, and/or the blade operating device 27 may include a plurality of operating members. The travel operating device 25, the ripper operating device 26, and/or the blade operating device 27 are not limited to levers and may be pedals or switches in another embodiment.

Figure 5:
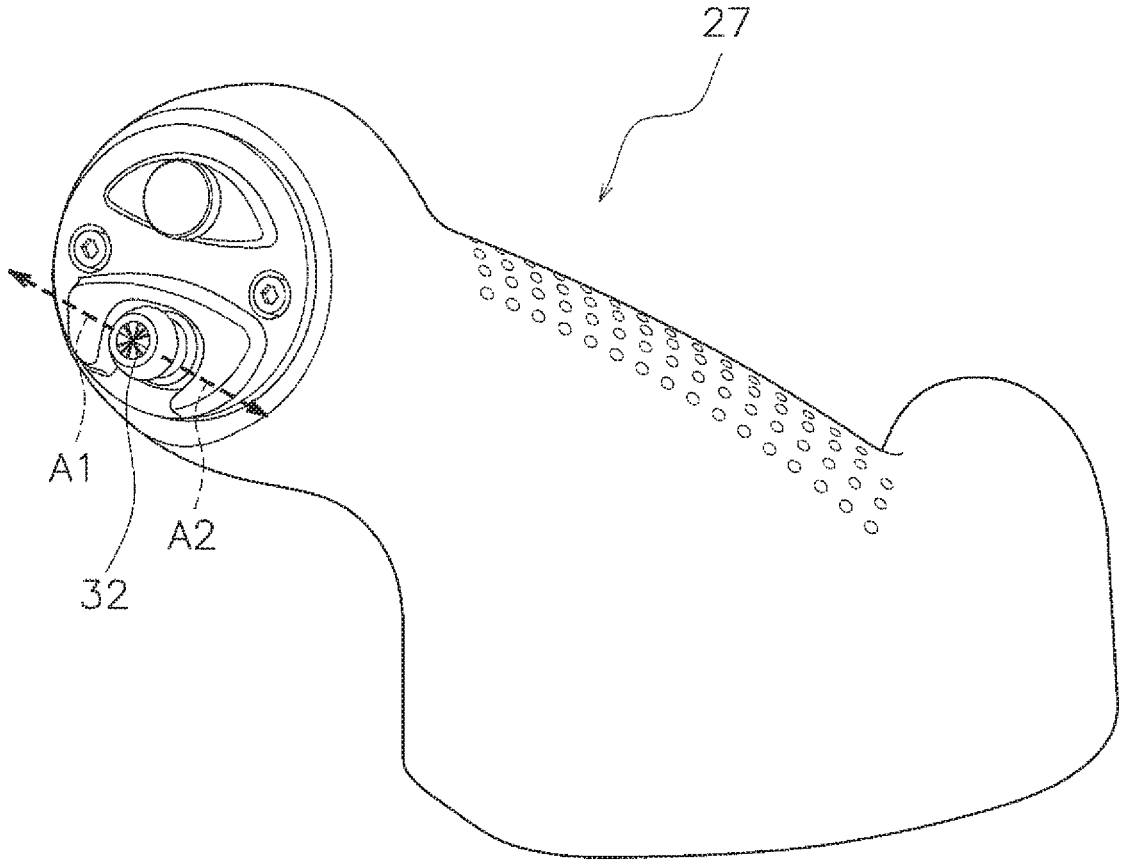
FIG. 5 is a perspective view of a blade operating device.

FIG. 5 is a perspective view of the blade operating device 27. As illustrated in FIG. 5, the pitch operating device 32 is provided on the blade operating device 27. The pitch operating device 32 is operable by tilting. Alternatively, the pitch operating device 32 may be operable by sliding. The pitch operating device 32 can be moved from a neutral position in FIG. 5 in a first direction A1 and a second direction A2. The first direction A1 and the second direction A2 are directions opposite from each other. The pitch operating device 32 is a momentary switch. The pitch operating device 32 returns to the neutral position when not operated.

The pitch operating device 32 outputs an operation signal in accordance with the operating direction of the pitch operating device 32. The pitch operating device 32 receives the operation by the operator and outputs the operation signal to the controller 28. The pitch movement of the blade 15 is controlled in accordance with the operating direction of the pitch operating device 32. Specifically, the pitch operating device 32 is operated in the first direction A1 whereby the blade 15 is tilted forward. The pitch operating device 32 is operated in the second direction A2 whereby the blade 15 is tilted rearward.

The controller 28 is programmed to control the bulldozer 1 based on acquired data. As illustrated in FIG. 3, the controller 28 includes a storage device 34 and a processor 35. The storage device 34 includes a non-volatile memory such as a ROM and a volatile memory such as a RAM. The storage device 34 may include an auxiliary storage device such as a hard disk or a solid state drive (SSD). The storage device 34 is an example of a non-transitory computerreadable recording medium. The storage device 34 stores computer commands and data for controlling the bulldozer 1.

The processor 35 may be, for example, a central processing unit (CPU). The processor 35 executes processing for controlling the bulldozer 1 in accordance with a program. The controller 28 controls the travel device 3 or the power transmission device 24 thereby causing the bulldozer 1 to travel. The controller 28 controls the control valve 29 whereby the blade 15 is moved up and down.

The control valve 29 a proportional control valve and is controlled by a command signal from the controller 28. The control valve 29 is disposed between hydraulic actuators and the hydraulic pump 23. The hydraulic actuators include the lift cylinders 16*a* and 16*b*, the tilt cylinders 17*a* and 17*b*, and the ripper cylinders 19 and 20.

The control valve 29 includes lift control valve 291 and 292, tilt control valve 293 and 294, and ripper control valve 295 and 296. The lift control valve 291 and 292 control the flow rate of the hydraulic fluid supplied from the hydraulic pump 23 to the lift cylinders 16*a* and 16*b*. The controller 28 generates instruction signals to the lift control valve 291 and 292 in accordance with the operation of the blade operating device 27. As a result, the lift cylinders 16*a* and 16*b* are controlled so that the blade 15 moves upward or downward.

The tilt control valve 293 and 294 control the flow rate of the hydraulic fluid supplied from the hydraulic pump 23 to the tilt cylinders 17*a* and 17*b*. The controller 28 generates instruction signals to the tilt control valve 293 and 294 in accordance with the operation of the blade operating device 27, As a result, the tilt cylinders 17*a* and 17*b* are controlled so that the blade 15 performs left tilting or right tilting. The controller 28 also generates instruction signals to the tilt control valve 293 and 294 in accordance with the operation of the pitch operating device 32. As a result, the tilt cylinders 17*a* and 17*b* are controlled so that the blade 15 performs forward tilting or rearward tilting.

The ripper control valve 295 and 296 control the flow rate of the hydraulic fluid supplied from the hydraulic pump 23 to the ripper cylinders 19 and 20. The controller 28 generates instruction signals to the ripper control valve 295 and 296 in accordance with the operation of the ripper operating device 26. As a result, the ripper cylinders 19 and 20 are controlled so that the ripper 18 moves.

The control valve 29 may be a pressure proportional control valve. In this case, a pilot pressure that corresponds to the operation of the blade operating device 27 may be inputted to the control valve 29. Alternatively, the control valve 29 may be an electromagnetic proportional control valve. An electrical signal that corresponds to the operation of the blade operating device 27 may be inputted to the control valve 29.

Figure 6:
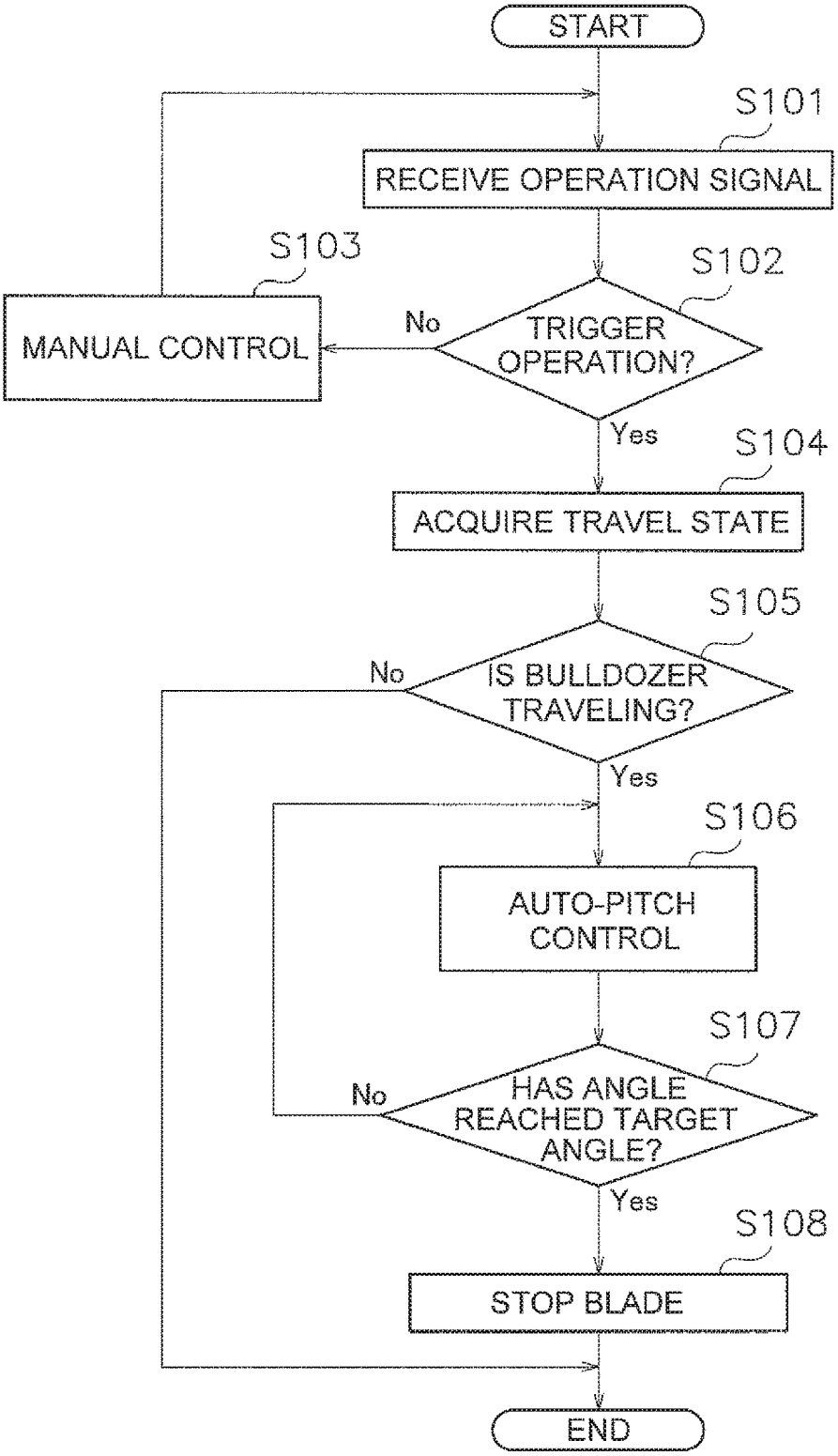
FIG. 6 is a flow chart of an auto-pitch control process.

The automatic control of the blade 15 is explained next. In the bulldozer 1 according to the present embodiment, the controller 28 executes an auto-pitch control for automatically controlling the pitch angle of the blade 15. The pitch angle is the tilting angle of the blade 15 in the front-back direction. The pitch angle is changed by the abovementioned pitch movement of the blade 15. FIG. 6 is a flow chart of an auto-pitch control process executed by the controller 28.

As illustrated in step S101 in FIG. 6, the controller 28 receives an operation signal from the pitch operating device 32. In step S102, the controller 28 determines whether the operation signal from the pitch operating device 32 represents a trigger operation for the auto-pitch control. The trigger operation is an operation in which a switch is pressed and held for a predetermined time period or longer. The predetermined time period is, for example, a time period from about one to two seconds. However, the predetermined time period is not limited in this way and may be less than one second or longer than two seconds.

When the operation signal from the pitch operating device 32 does not represent the trigger operation, the processing advances to step S103. That is, when the operation signal from the pitch operating device 32 represents a normal operation for manual operation of the blade 15, the processing advances to step S103. In step S103, the controller 28 changes the pitch angle according to the manual operation. In the manual control, the controller 28 changes the pitch angle while the pitch operating device 32 is being operated by the operator.

For example, while the pitch operating device 32 is being operated in the first direction A1, the controller 28 keeps the blade 15 moving so that the blade 15 tilts forward. While the pitch operating device 32 is being operated in the second direction A2, the controller 28 keeps the blade 15 moving so that the blade 15 tilts rearward. The controller 28 causes the blade 15 to stand still without performing a pitch movement when the pitch operating device 32 is not operated by the operator. That is, when the pitch operating device 32 is returned to the neutral position after the operation of the pitch operating device 32, the controller 28 stops the pitch movement of the blade 15.

When the controller 28 determines that the operation signal from the pitch operating device 32 represents the trigger operation in step S102, the processing advances to step S104. In step S104, the controller 28 acquires the traveling state of the bulldozer 1. The traveling state includes forward travel, reverse travel, and stopping. The controller 28 acquires the traveling state, for example, based on the operation signal from the travel operating device 25. Alternatively, the controller 28 may acquire the traveling state by detecting the state of the travel device 3 or the power transmission device 24. Alternatively, the controller 28 may acquire the traveling state with a positional sensor such as a global positioning system (GPS).

In step S105, the controller 28 determines whether the bulldozer 1 is traveling. The controller 28 determines whether the bulldozer 1 is traveling based on the traveling state acquired in step S104. The controller 28 does not execute the automatic control when it is determined that the bulldozer 1 is not traveling. That is, the controller 28 disables the trigger operation when it is determined that the bulldozer 1 is stopped.

When the controller 28 determines that the bulldozer 1 is traveling, the process advances to step S106.

In step S106, the controller 28 changes the pitch angle according to the auto-pitch control. In the auto-pitch control, the controller 28 moves the blade 15 until the pitch angle of the blade 15 has reached the target angle even if the pitch operating device 32 has returned to the neutral position.

In step S107, the controller 28 determines whether the pitch angle of the blade 15 has reached the target angle. When the pitch angle of the blade 15 has reached the target angle, in step S108, the controller 28 stops the pitch movement of the blade 15.

Figure 7A:
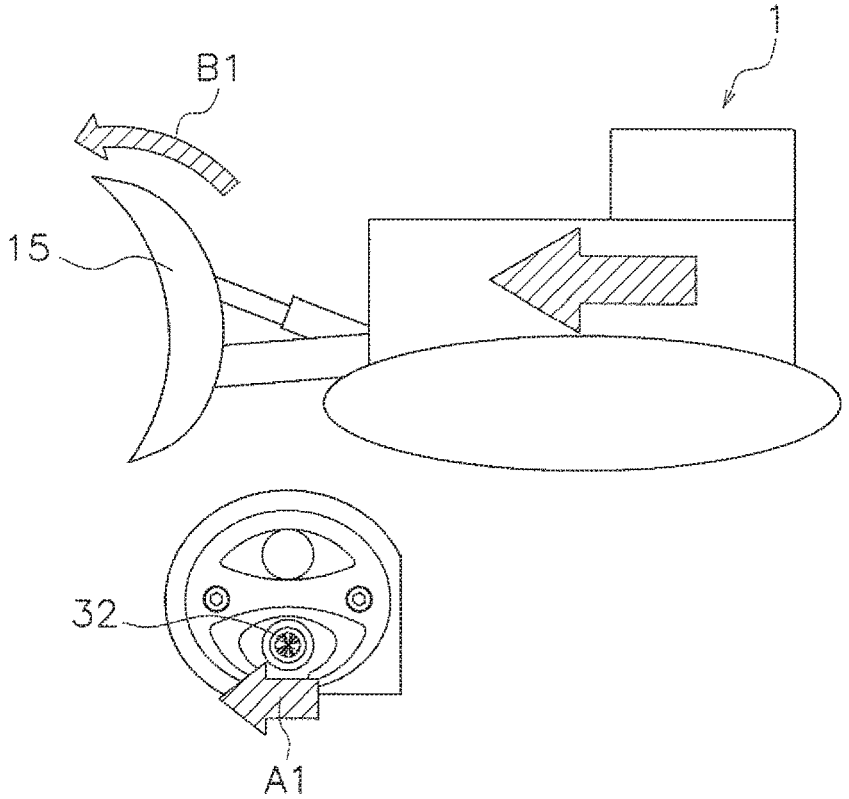
FIG. 7A illustrates the auto-pitch control during forward travel of the bulldozer.
Figure 7B:
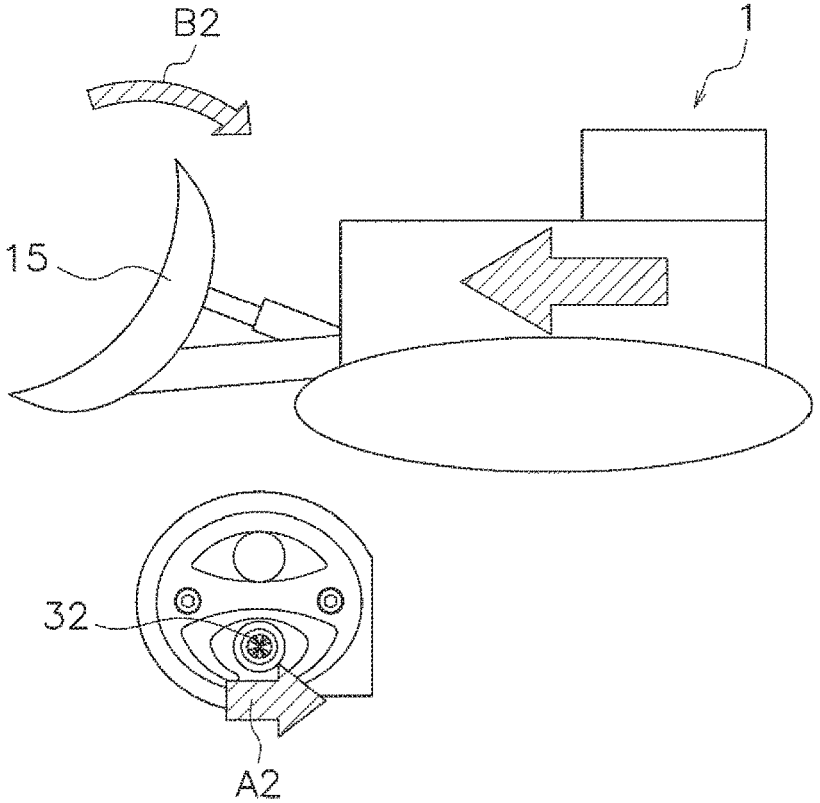
FIG. 7B illustrates the auto-pitch control during forward travel of the bulldozer.
Figure 8A:
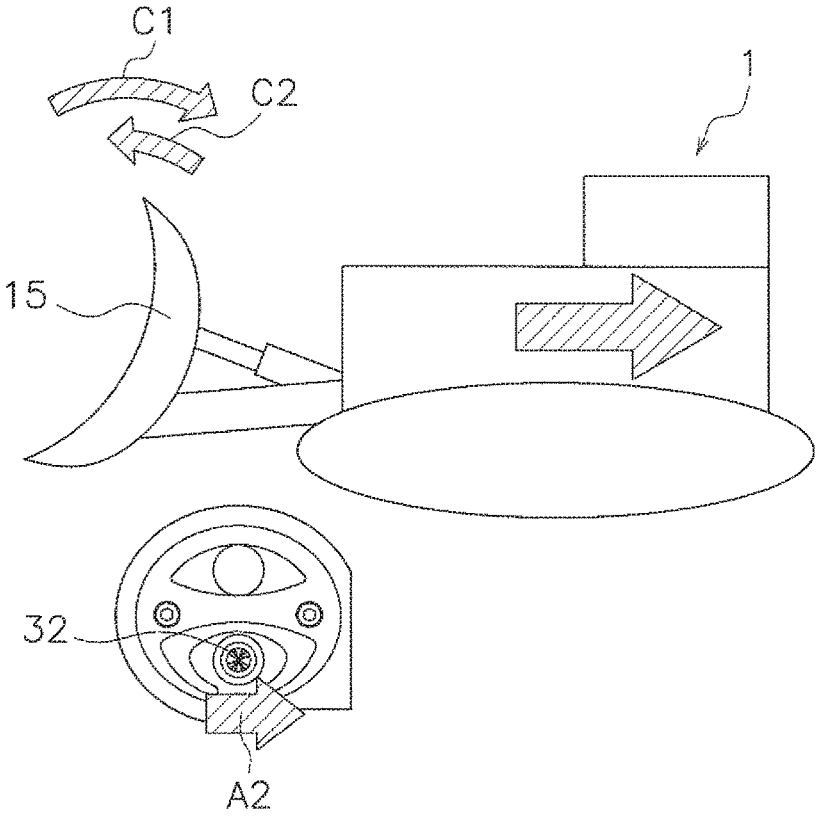
FIG. 8A illustrates the auto-pitch control during reverse travel of the bulldozer.
Figure 8B:
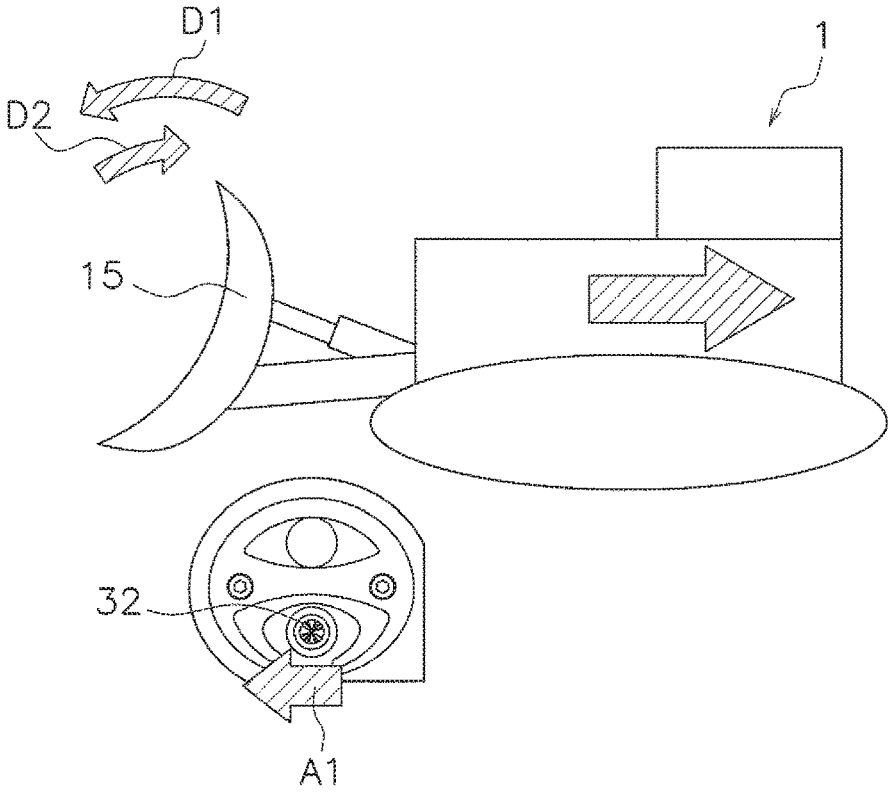
FIG. 8B illustrates the auto-pitch control during reverse travel of the bulldozer.

FIGS. 7A and 7B illustrate the auto-pitch control during forward travel of the bulldozer 1. FIGS. 8A and 8B illustrate the auto-pitch control during reverse travel of the bulldozer 1. The controller 28 determines whether the bulldozer 1 is traveling forward or reverse. When the controller 28 determines that the operation signal from the pitch operating device 32 represents the trigger operation while the bulldozer 1 is traveling forward, the controller 28 moves the blade 15 until the angle of the blade 15 reaches a first target angle.

The controller 28 changes the first target angle in accordance with the operating direction of the pitch operating device 32. As illustrated in FIG. 7A, when the operation signal from the pitch operating device 32 represents the trigger operation in the first direction A1 while the bulldozer 1 is traveling forward, the controller 28 sets the first target angle to an angle that suits dumping The angle that suits dumping is, for example, the maximum pitch angle in the forward direction. As illustrated by arrow B1 in FIG. 7A, the controller 28 tilts the blade 15 forward until the pitch angle reaches the maximum pitch angle in the forward direction. The maximum pitch angle in the forward direction is the pitch angle when the tilt cylinders 17*a* and 17*b* reach the stroke ends in the extension direction. However, the angle that suits dumping may be less than the maximum pitch angle in the forward direction.

As illustrated in FIG. 7B, when the operation signal from the pitch operating device 32 represents the trigger operation in the second direction A2 while the bulldozer 1 is traveling forward, the controller 28 sets the first target angle to an angle that suits earth moving. The angle that suits earth moving is, for example, the maximum pitch angle in the rearward direction. As illustrated by arrow B2 in FIG. 7B, the controller 28 tilts the blade 15 rearward until the pitch angle reaches the maximum pitch angle in the rearward direction. The maximum pitch angle in the rearward direction is the pitch angle when the tilt cylinders 17*a* and 17*b* reach the stroke ends in the contraction direction. However; the angle that suits earth moving may be less than the maximum pitch angle in the rearward direction.

When the controller 28 determines that the operation signal from the pitch operating device 32 represents the trigger operation while the bulldozer 1 is traveling in reverse, the controller 28 moves the blade 15 until the angle of the blade 15 reaches a second target angle. The second target angle is different from the first target angle. The second target angle is an angle between the maximum pitch angle in the forward direction and the maximum pitch angle in the rearward direction. The second target angle is an angle that suits excavation. The second target angle is set beforehand and is saved in the storage device 34. The second target angle may be fixed value. Alternatively, the second target angle may be changeable.

As illustrated in FIG. 8A, when the operation signal from the pitch operating device 32 represents the trigger operation in the second direction A2 while the bulldozer 1 is traveling in reverse, the controller 28 first tilts the blade 15 up to the maximum pitch angle in the rearward direction as indicated by arrow C1, and then tilts the blade 15 forward up to the second target angle as indicated by the arrow C2. That is, when the operation signal from the pitch operating device 32 represents the trigger operation in the second direction A2 while the bulldozer 1 is traveling in reverse, the controller 28 changes the pitch angle to the second target angle after passing through the maximum pitch angle in the rearward direction.

As illustrated in FIG. 8B, when the operation signal from the pitch operating device 32 represents the trigger operation in the first direction A1 while the bulldozer 1 is traveling in reverse, the controller 28 first tilts the blade 15 up to the maximum pitch angle in the forward direction as indicated by the arrow D1, and then tilts the blade 15 rearward up to the second target angle as indicated by the arrow D2. That is, when the operation signal from the pitch operating device 32 represents the trigger operation in the first direction A1 while the bulldozer 1 is traveling in reverse, the controller 28 changes the pitch angle to the second target angle after passing through the maximum pitch angle in the forward direction.

The controller 28 uses a timer when changing the pitch angle up to the second target angle. After the tilt cylinders 17*a* and 17*b* have reached the stroke ends, the controller 28 tilts the blade 15 forward or rearward until a predetermined action time period has been completed. At the point in time that the predetermined action time period has been completed after the tilt cylinders 17*a* and 17*b* have reached the stroke ends, the controller 28 stops the forward tilt or rearward tilt of the blade 15.

Figure 9:
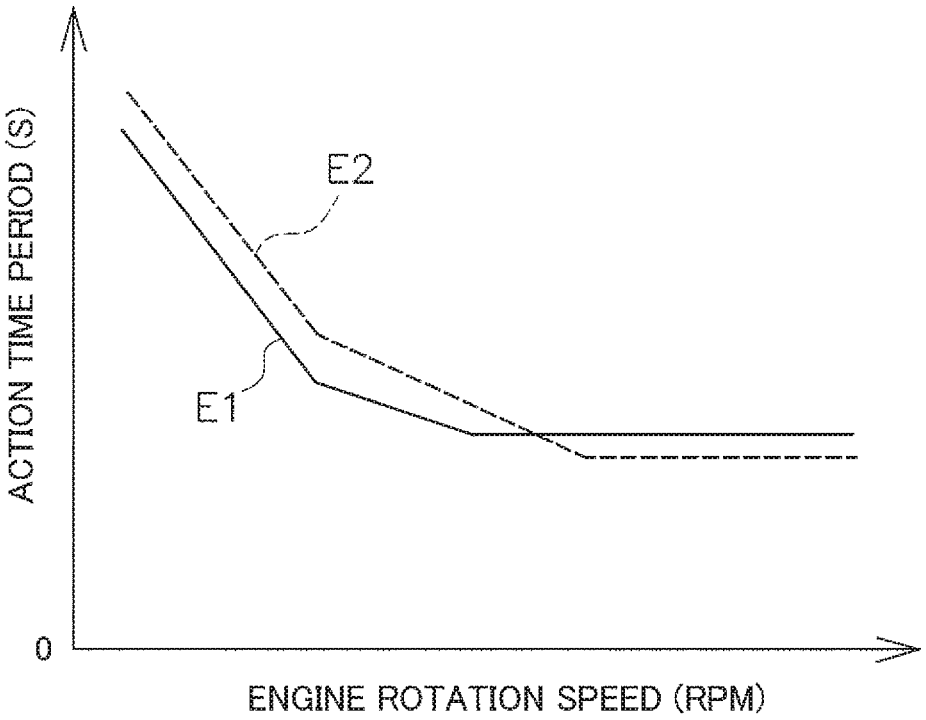
FIG. 9 is an example of action time data.

The controller 28 refers to action time period data illustrated in FIG. 9 to determine the action time period in accordance with the engine rotation speed. The action time period data defines the relationship between the engine rotation speed and the action time period. The action time period data is saved in the storage device 34. The action time period data defines an action time period that decreases in accordance with an increase in the engine rotation speed.

The action time period data includes first data E1 and second data E2. The first data E1 defines the relationship between the engine rotation speed and the action time period when the trigger operation is performed in the first direction A1 while the bulldozer 1 is traveling in reverse. The second data E1 defines the relationship between the engine rotation speed and the action time period when the trigger operation is performed in the second direction A2 while the bulldozer 1 is traveling in reverse.

In the control system 6 of the bulldozer 1 according to the present embodiment as explained above, the operator is able to use the pitch operating device 32 to indicate both the manual control and the automatic control of the blade 15. Consequently, operability for adjusting the angle of the blade 15 is improved in the bulldozer 1.

The configuration of the bulldozer 1 is not limited to the above embodiment and may be changed. For example, the bulldozer 1 may be driven by an electric motor. The second work implement 5 may be omitted. The configuration of the control system 6 is not limited to the above embodiment and may be changed. The bulldozer 1 may be remotely operable. In this case, a portion of the control system 6 may be disposed outside of the bulldozer 1.

Figure 10:
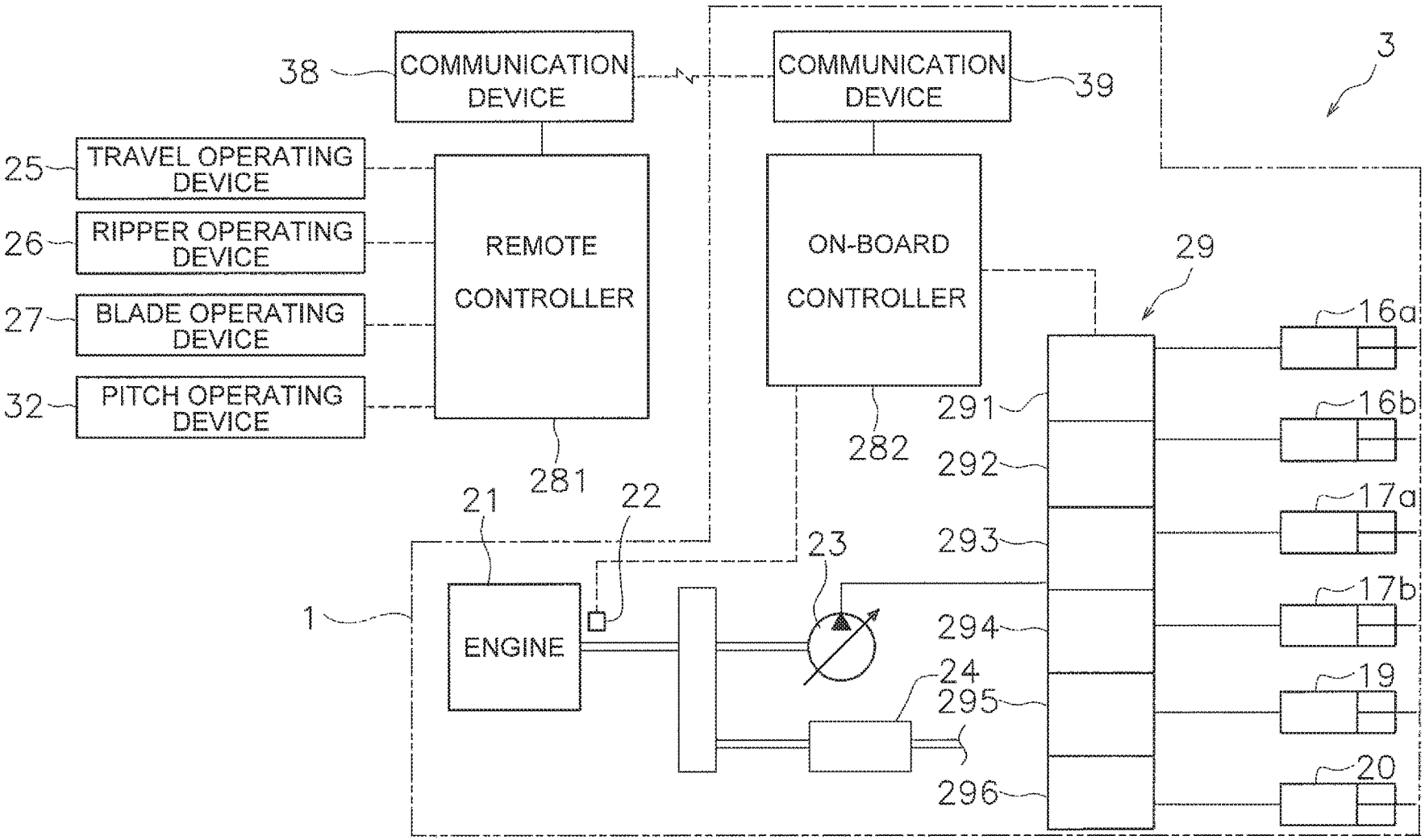
FIG. 10 is a block diagram of another example of a configuration of the control system.

For example as illustrated in FIG. 10, the controller 28 may include a remote controller 281 and an on-board controller 282. The remote controller 281 may be disposed outside of the bulldozer 1. For example, the remote controller 281 may be disposed in a management center outside of the bulldozer 1. The on-board controller 282 may be mounted on the bulldozer 1.

The travel operating device 25, the ripper operating device 26, the blade operating device 27, and/or the pitch operating device 32 may be disposed outside of the bulldozer 1. The travel operating device 25, the ripper operating device 26, the blade operating device 27, and/or the pitch operating device 32 may be omitted from the bulldozer 1. In this case, the operating cabin 11 may be omitted from the work vehicle 1.

The remote controller 281 and the on-board controller 282 may be able to communicate wirelessly through communication devices 38 and 39. A portion of the functions of the abovementioned controller 28 may be executed by the remote controller 281 and the remaining functions may be executed by the on-board controller 282.

The structures or the dispositions of the travel operating device 25, the ripper operating device 26, the blade operating device 27, and/or the pitch operating device 32 are not limited to the above embodiment and may be changed. For example, the pitch operating device 32 is not limited to the shape of the above embodiment and may have another shape such as a lever shape.

The processes of the automatic control of the blade 15 are not limited to the above embodiment and may be changed, omitted, or other processes may be added. The sequence of the execution of the processes of the automatic control is not limited to the above embodiment and may be changed.

The trigger operation is not limited to pushing and holding and may be another operation. For example, the trigger operation may be a predetermined number of continuous clicks of the pitch operating device 32. The predetermined number may be two clicks, for example. Alternatively, the predetermined number may be more than two.

The control system 6 may be provided with an angle sensor for detecting the angle of the blade 15. The angle sensor may also detect the pitch angle. The controller 28 may use the pitch angle detected by the angle sensor to change the pitch angle to the second target angle.

When the traveling direction of the bulldozer 1 is changed during the auto-pitch control, the controller 28 may end the auto-pitch control. When the bulldozer 1 stops during the auto-pitch control, the controller 28 may end the auto-pitch control. When the ripper operating device 26 is operated during the auto-pitch control, the controller 28 may end the auto-pitch control. Alternatively, when any of the above operations are performed during the auto-pitch control, the controller 28 may temporarily end the auto-pitch control. When said operation is ended, the auto-pitch control may be restarted.

The automatic control of the blade 15 is performed for the pitch movement in the above embodiment. However, the automatic control is not limited to the pitch movement, and the automatic control of the blade 15 may be performed on another operation such as the lift operation or the tilt operation.

Although an embodiment of the present invention has been described, the present invention is not limited to the above embodiment and various modifications may be made within the scope of the invention.

What is claimed is:

1. A system for controlling a bulldozer including a blade, the system comprising:

an operating device that outputs a signal corresponding to an operation by an operator, the operating device being a switch operable in a predetermined direction; and a controller configured to receive the signal from the operating device, determine that the signal from the operating device represents either a normal operation to manually control the blade, the normal operation being operation of the operating device in the predetermined direction for less than a predetermined time period, or a trigger operation to automatically control the blade, the trigger operation being operation of the operating device in the predetermined direction for the predetermined time period or longer, move the blade so that the angle of the blade changes in accordance with the operation of the operating device when the signal from the operating device is determined as representing the normal operation, and move the blade until the angle of the blade reaches a predetermined target angle when the signal from the operating device is determined as representing the trigger operation while the bulldozer is traveling.

2. The system according to claim 1, wherein the operating device is operable in a plurality of directions, and the controller is further configured to change the predetermined target angle in accordance with an operating direction of the operating device.

3. The system according to claim 1, wherein the predetermined target angle is any of an angle that suits excavation, an angle that suits dumping, and an angle that suits earth moving.

4. The system according to claim 3, wherein the angle that suits dumping is a maximum pitch angle in a forward direction of the bulldozer.

5. The system according to claim 3, wherein the angle that suits earth moving is a maximum pitch angle in a rearward direction of the bulldozer.

6. The system according to claim 1, wherein the controller is further configured to determine whether the bulldozer is traveling forward or traveling in reverse, and move the blade until the angle of the blade reaches a first target angle when the signal from the operating device is determined as representing the trigger operation while the bulldozer is traveling forward, and move the blade until the angle of the blade reaches a second target angle different from the first target angle when the signal from the operating device is determined as representing the trigger operation while the bulldozer is traveling in reverse.

7. The system according to claim 6, wherein the first target angle is an angle that suits dumping or is an angle that suits earth moving, and the second target angle is an angle that suits excavation.

8. A method for controlling a bulldozer including a blade, the method comprising:

receiving a signal in accordance with an operation of an operating device by an operator, the operating device being a switch operable in a predetermined direction;

determining that the signal represents either a normal operation to manually control the blade, the normal operation being operation of the operating device in the predetermined direction for less than a predetermined time period, or a trigger operation to automatically control the blade, the trigger operation being operation of the operating device in the predetermined direction for the predetermined time period or longer; and moving the blade so that the angle of the blade changes in accordance with the operation of the operating device when the signal is determined as representing a normal operation; and moving the blade until the angle of the blade reaches a predetermined target angle when the signal is determined as representing the trigger operation while the bulldozer is traveling.

9. The method according to claim 8, wherein the operating device is operable in a plurality of directions, and the method further includes changing the predetermined target angle in accordance with an operating direction of the operating device.

10. The method according to claim 8, wherein
the predetermined target angle is any of
an angle that suits excavation,
an angle that suits dumping, and
an angle that suits earth moving.

11. The method according to claim 10, wherein
the angle that suits dumping is a maximum pitch angle in a forward direction of the bulldozer.

12. The method according to claim 10, wherein
the angle that suits earth moving is a maximum pitch angle in a rearward direction of the bulldozer.

13. The method according to claim 8, further comprising:
determining whether the bulldozer is traveling forward or traveling in reverse,
moving the blade until the angle of the blade reaches a first target angle when the signal from the operating device is determined as representing the trigger operation while the bulldozer is traveling forward, and
moving the blade until the angle of the blade reaches a second target angle different from the first target angle when the signal from the operating device is determined as representing the trigger operation while the bulldozer is traveling in reverse.

14. The method according to claim 13, wherein
the first target angle is an angle that suits dumping or is an angle that suits earth moving, and
the second target angle is an angle that suits excavation.

* * * * *